United States Patent [19]

Montgomery

[11] 3,956,853

[45] May 18, 1976

[54] LOCKABLE AND RELEASABLE PARKING SPACE BARRIER

[76] Inventor: George R. Montgomery, 1152 Okeechobee Road, West Palm Beach, Fla. 33401

[22] Filed: Oct. 15, 1975

[21] Appl. No.: 622,526

Related U.S. Application Data

[63] Continuation-in-part of Ser. No. 560,334, March 21, 1975, Pat. No. 3,925,929.

[52] U.S. Cl. ..... 49/35; 49/131

[51] Int. Cl.[2] ..... E05B 65/00; E06B 11/00

[58] Field of Search ..... 49/35, 131; 52/169

[56] References Cited

UNITED STATES PATENTS

| | | | |
|---|---|---|---|
| 3,061,960 | 11/1962 | Dull | 49/35 |
| 3,417,508 | 12/1968 | Sprung | 49/35 |
| 3,680,448 | 8/1972 | Ballingall et al. | 52/169 |
| 3,688,439 | 9/1972 | Doxsee | 49/131 |

FOREIGN PATENTS OR APPLICATIONS

| | | | |
|---|---|---|---|
| 1,401,359 | 4/1965 | France | 49/35 |
| 967,322 | 8/1964 | United Kingdom | 49/131 |

*Primary Examiner*—Donald A. Griffin
*Attorney, Agent, or Firm*—D. Paul Weaver

[57] ABSTRACT

To prevent unauthorized use of a private or reserved vehicle parking space, a barrier post is locked in an upright position by a fail-safe lower end shear pin and is releasable for pivoting to a horizontal position at floor level which allows a vehicle to enter or leave the parking space.

5 Claims, 5 Drawing Figures

FIG. 1
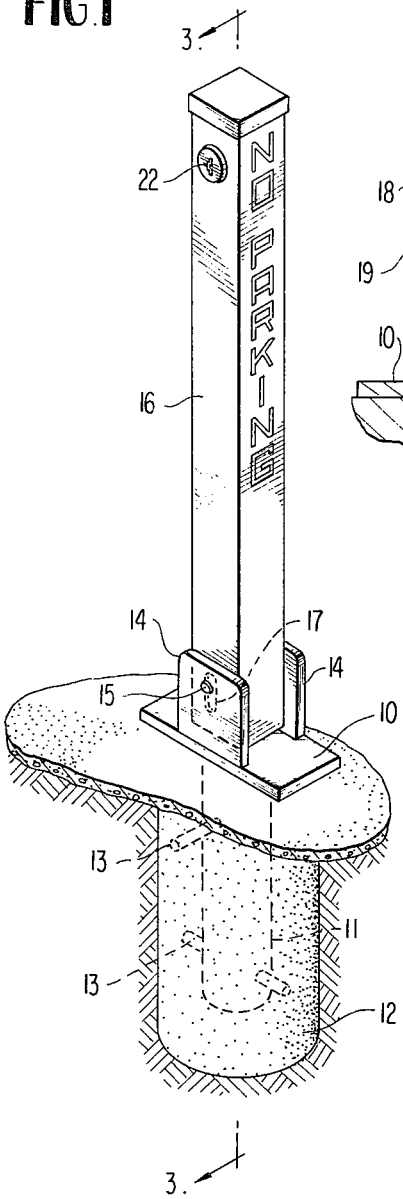
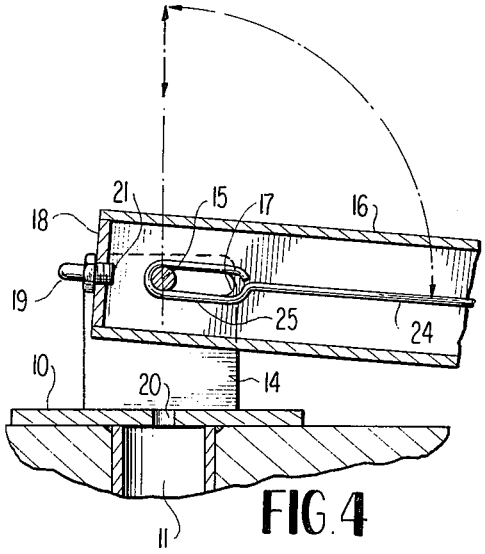
FIG. 4
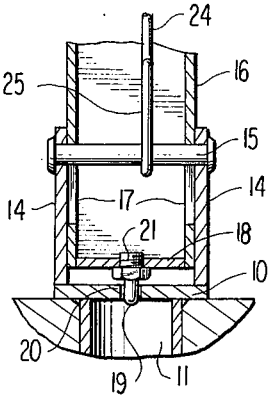
FIG. 5
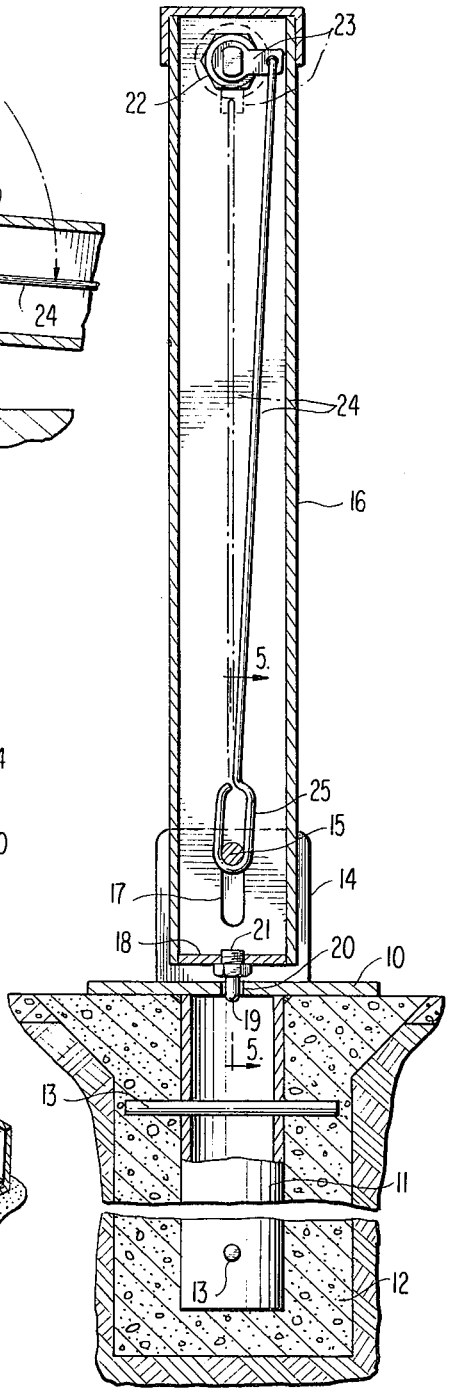
FIG. 3
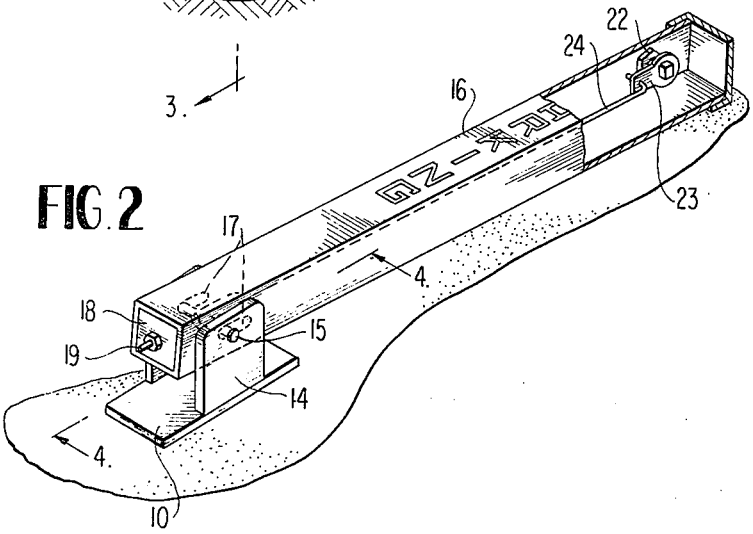
FIG. 2

LOCKABLE AND RELEASABLE PARKING SPACE BARRIER

CROSS-REFERENCE TO RELATED APPLICATION

This application is a continuation-in-part of prior copending application Ser. No. 560,334, filed Mar. 21, 1975 and now U.S. Pat. No. 3,925,929 issued Dec. 16, 1975, for PARKING SPACE BARRIER.

BACKGROUND OF THE INVENTION

Reserved or private parking space barriers are known in the prior art and examples of the patented prior art are shown in U.S. Pat. Nos. 3,417,508; 3,688,439 and British patent specification No. 967322.

Such prior art devices have not been widely accepted mainly due to the fact that they are too complicated and too expensive to be completely practical for commercial purposes. Accordingly, it is the object of this invention to improve on the prior art by providing a parking space barrier post of extreme simplicity and economy as well as ease of operation. With these qualities, the invention will be entirely practical commercially and feasible to utilize in parking garages and lots. In addition to its simplicity and economy of manufacture, the device is constructed to avoid any serious damage to automobiles if accidentally struck, and embodies a concealed shear pin in its lower end which will fail under impact to avoid damaging either the automobile or the barrier device. The shear pin is readily replaceable. It is sufficiently strong to resist manual pressure against the barrier post, as where an unauthorized user would attempt to force the post downwardly by hand and without possessing the required key to unlock the device.

Other features and advantages of the invention will become apparent during the course of the following description.

BRIEF DESCRIPTION OF DRAWING FIGURES

FIG. 1 is a perspective view of a parking space barrier device embodying the invention shown in the upright active and locked position.

FIG. 2 is a perspective view of the device in an unlocked and lowered position, partly in section.

FIG. 3 is an enlarged vertical section taken on line 3—3 of FIG. 1.

FIG. 4 is a similar section taken on line 4—4 of FIG. 2.

FIG. 5 is a fragmentary vertical section taken on line 5—5 of FIG. 3.

DETAILED DESCRIPTION

Referring to the drawings in detail, wherein like numerals designate like parts, the numeral 10 designates a flat base or mounting plate having a central depending vertical pipe extension 11 rigid therewith and adapted to be anchored in concrete 12, which may be part of a garage floor structure or a mass of concrete in the case of an unpaved parking lot. The anchoring pipe 11 preferably has cross rods 13 embedded in the concrete for additional security.

The horizontal base plate 10 carries a pair of spaced parallel upright bracket plates 14 rigid therewith, and these bracket plates are interconnected near their tops centrally by a sturdy cross pin 15 fixed thereto. This cross pin is held by a pair of aligned openings in the plates 14 as clearly shown in FIG. 5.

A barrier post 16, preferably of rectangular cross section, is provided and is of a height to extend somewhat above the bumper level of automobiles. The post 16 is provided near its bottom and in its sides which are arranged between the bracket plates 14 with a pair of aligned elongated slots 17 which extend longitudinally of the post 16 and receive therethrough the cross pin 15 with which the post is pivotally and slidably connected through the two slots.

The post 16 has a rigid bottom plate 18 fixed thereto and this bottom plate is spaced slightly from the base plate 10, FIG. 3, when the barrier is in the upstanding locked or active position. A locking shear pin 19 depends from the center of the bottom plate 18 and is received by a cooperating locking opening 20 formed centrally through the base plate 10. The shear pin 20 has a threaded extension 21 received removably within a screw-threaded opening in the post bottom plate 18, thus allowing replacement by a new shear pin whenever required. As shown in the drawings, the single shear pin 19 arranged centrally at the bottom of the barrier post is substantially concealed from view and inaccessible to intruders when the post is in the upright position. However, when the post is in the down position, FIGS. 2 and 4, the pin 19 is readily exposed and accessible.

A simplified locking and release means for the barrier post is provided in the form of a key lock 22 near the top of the post on one side thereof and with the rotational axis of the key lock parallel to the axis of the pin 15. The rotary component of the key lock carries a crank arm 23 concealed within the interior of the post, and this arm is connected with the upper end of a rod 24 having an elongated closed loop 25 at its lower end slidably receiving the fixed cross pin 15 held in bracket plates 14.

During use, the barrier post 16 is secured in the upright locked position by shear pin 19 engaging in the opening 20 of base plate 10. The key lock 22 at this time is positioned by the key so that the crank arm 23 is horizontal, FIG. 3, and the rod 24 and loop 25 are elevated with the fixed pin 15 resting in the bottom of the loop 25. Under these circumstances, the post 16 can neither be pivoted on the pin 15 or lifted vertically relative thereto, as the rod 24 prevents this. Hence, the shear pin 19 is locked in the opening 20.

Should an automobile strike the post 16, the pin 19 will shear or fail and prevent damage to the barrier device or automobile. The shear pin can easily be replaced by a new pin when this happens due to the threaded element 21.

To unlock the post 16 so that it may assume the down position of FIG. 2, the key lock is operated to swing the crank arm 23 to the vertical depending position shown in broken lines in FIG. 3. This, in turn, lowers the rod 24 and elongated loop 25 relative to fixed cross pin 15, and allowing the post 16 to be lifted sufficiently to disengage the shear pin 19 from locking opening 20. The slots 17 then slide relative to pin 15 and after lifting the post 16 is pivoted down on its side horizontally and may rest on the floor or ground to permit passage of a vehicle over it. This is all possible because the loop 25, when lowered, relative to the pin 15 by operation of the proper key, allows the post to be lifted relative to the pin 15 sufficiently to remove the pin 19 from the opening 20.

To return the barrier post to the upright position, it is merely swung upwardly on the axis of pin 15 and slightly lifted to allow re-entry of the pin 19 into the opening 20 and then locked by the key to return the rod 24 to the raised full line locking position of FIG. 3.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A lockable and releasable parking space barrier comprising a base member adapted to be fixed to a floor or to the ground and having spaced upright elements and a bottom substantially horizontal plate provided with a locking opening between the upright elements, a cross pin secured to and extending between the upright elements at an elevation above the horizontal plate and locking opening, a barrier post engaging between the upright elements and above said horizontal plate and having a pivotal and sliding connection with the cross pin, said barrier post including a lower end wall, a locking pin dependingly secured to said lower end wall and being engageable within said locking opening below the lower end wall, and key operable means on said barrier post above the cross pin including a movable element having a lost motion connection with the cross pin, whereby in one position of the key operable means said post and locking pin are liftable relative to said horizontal plate to remove the locking pin from the locking opening of the horizontal plate.

2. A lockable and releasable parking space barrier as defined by claim 1, and said pivotal and sliding connection formed by elongated longitudinally extending aligned slots in opposite side walls of the barrier post, said slots receiving said cross pin pivotally and slidably.

3. A lockable and releasable parking space barrier as defined by claim 2, and said post being rectangular in cross section with said slots formed through one opposing pair of side walls of the post near the lower end thereof.

4. A lockable and releasable parking space barrier as defined by claim 1, and said locking pin comprising a shear pin having threaded engagement with said lower end wall whereby the shear pin is rendered replaceable by a new pin after shearing.

5. A lockable and releasable parking space barrier as defined by claim 1, and said movable element having said lost motion connection with the cross pin comprising a link inside of said barrier post having an elongated loop on one end thereof receiving the cross pin slidably and pivotally, and a crank arm connected with the other end of the link and secured to a rotary part of said key operable means accessible by means of a key from the exterior of the post.

* * * * *